US008652742B2

(12) United States Patent
Matsushima et al.

(10) Patent No.: US 8,652,742 B2
(45) Date of Patent: Feb. 18, 2014

(54) METHOD FOR PRODUCING PRINT HAVING FOIL IMAGE AND TONER IMAGE

(75) Inventors: Asao Matsushima, Tokyo (JP); Tatsuya Nagase, Tokyo (JP); Yasuko Uchino, Tokyo (JP); Aya Shirai, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 161 days.

(21) Appl. No.: 13/314,544

(22) Filed: Dec. 8, 2011

(65) Prior Publication Data

US 2012/0156609 A1 Jun. 21, 2012

(30) Foreign Application Priority Data

Dec. 16, 2010 (JP) ..... 2010-280241

(51) Int. Cl.
*G03G 13/14* (2006.01)

(52) U.S. Cl.
USPC ..... 430/125.31; 430/126.1; 156/701

(58) Field of Classification Search
USPC ..... 430/126.1, 125.31; 156/701
See application file for complete search history.

(56) References Cited

U.S. PATENT DOCUMENTS

| | | | | | |
|---|---|---|---|---|---|
| 3,903,320 | A * | 9/1975 | Erhardt et al. | ..... | 430/124.21 |
| 3,928,656 | A * | 12/1975 | Strella et al. | ..... | 430/123.54 |
| 4,371,599 | A * | 2/1983 | Lind et al. | ..... | 430/49.4 |
| 4,724,026 | A * | 2/1988 | Nelson | ..... | 156/233 |
| 4,925,763 | A * | 5/1990 | Tsubuko et al. | ..... | 430/108.9 |
| 5,314,778 | A * | 5/1994 | Smith et al. | ..... | 430/108.22 |
| 5,985,503 | A * | 11/1999 | de Beeck et al. | ..... | 430/124.53 |
| 2003/0198793 | A1* | 10/2003 | Landa et al. | ..... | 428/209 |
| 2011/0229819 | A1* | 9/2011 | Hiramoto et al. | ..... | 430/124.13 |

FOREIGN PATENT DOCUMENTS

| | | | | |
|---|---|---|---|---|
| EP | 864939 | A1 * | 9/1998 | ..... G03G 15/16 |
| GB | 2231533 | A * | 11/1990 | ..... G03G 13/16 |
| JP | 61-252190 | | 11/1986 | |
| JP | 05-279608 | | 10/1993 | |
| JP | 2009-226863 | | 10/2009 | |
| WO | WO 9112145 | A1 * | 8/1991 | ..... B44C 1/17 |
| WO | WO 9308034 | A1 * | 4/1993 | ..... B41M 5/40 |

* cited by examiner

*Primary Examiner* — Christopher Rodee
(74) *Attorney, Agent, or Firm* — Lucas & Mercanti, LLP

(57) ABSTRACT

Provided is a method for producing a print having a toner image and a foil image, the method containing the steps of forming a foil transferring toner image with a foil transferring toner on an image supporting substrate produced; heating and pressing by laminating the foil transferring toner image onto a transferring foil layer of a transferring foil sheet which is composed of the transferring foil layer and a base film; forming a foil image having the transferring foil layer on the foil transferring toner image by peeling off the base film after cooling the foil transferring toner image with the transferring foil layer; and forming a toner image with an image forming toner on the image supporting substrate having the foil transferring image, wherein the foil transferring toner contains a resin produced by a vinyl monomer represented by Formula (1) and a polyvalent metal compound:

Formula (1)

8 Claims, 3 Drawing Sheets

METHOD FOR PRODUCING PRINT HAVING FOIL IMAGE AND TONER IMAGE

CROSS REFERENCE TO RELATED APPLICATION

This application is based on Japanese Patent Application No. 2010-280241 filed on Dec. 16, 2010 with Japan Patent Office, the entire content of which is hereby incorporated by reference.

TECHNICAL FIELD

The present invention relates to a method for producing a print having a foil image and a toner image.

BACKGROUND

There is known the technology to produce a foil image employing a transferring foil made of gold, silver, aluminium, or a hologram, by foil transfer on an image supporting substrate. The foil transfer is usually performed by a hot stamping method. This method is composed of the steps of heating a metal mold which makes a transferring image to rise in a convex form; pressing this convex portion to a transferring foil sheet composed of a base film, a releasing layer, a colorant layer and an adhesion layer; melting the adhesion layer of the transferring foil material to adhere on the image supporting substrate; and peeling the base film from the releasing layer after cooling to result in forming an foil image on the image supporting substrate. However, this hot stamping method required time and cost for producing the metal mold, and it was unsuitable for producing various kinds of foil images in small lot production.

The following foil transfer method is disclosed in order to reduce the time and cost of this metal mold production. This method is composed of the steps of preparing a W/O emulsion ink containing a hot melt adhesive agent in an oil phase, or both in an oil phase and an aqueous phase; forming an ink layer on a supporting substrate to be transferred an image with this hot melt W/O emulsion ink; then laminating the produced ink layer with the transferring foil, followed by thermally pressing them (for example, refer to Patent document 1).

However, although the above-described method of laminating the produced ink layer using this hot melt W/O emulsion ink with the transferring foil followed by thermally pressing them has an effect of reducing the time and cost of the hot stamping method in the point of not using a metal mold, it is necessary to produce a screen printing base paper for each copy. As a result, the effect of reducing the time and cost was still insufficient.

Moreover, the following foil image production method is disclosed. This method is composed of the steps of forming a fixed toner image used for supporting a foil image on an image supporting substrate; laminating a transferring foil sheet on the aforesaid toner image; then laminating a flexible sheet having a less thickness than the aforesaid image supporting substrate; heating and pressing them (the flexible sheet, the transferring foil sheet and the image supporting substrate) together by passing through a pair of rollers; and peeling off the flexible sheet and the transferring foil sheet from the image supporting substrate after cooling (for example, refer to Patent document 2).

Moreover, the following ink jet recording apparatus is disclosed to form an image having a foil image on the recording medium. This ink-jet recording apparatus is composed of an on-demand droplet ejecting head which imagewise ejects liquid containing an active energy ray polymerizable compound and a polymerization initiator either on a recording medium or on a foil; an image forming device to form an image made of a pressure sensitive adhesive agent either on the recording medium or on the foil by irradiating the aforesaid ejected liquid with an active energy ray; a foil image forming device to form an foil image on the formed adhesive agent image by transferring one of the recording medium and the foil; and ink-jet head to form an image on the recording medium on which the aforesaid foil image has been formed by ejecting an ink containing a colorant (for example, refer to Patent document 3).

In recent years, there has been increased a demand for a print having both a foil image and an overprinting image. This print is made by performing post-printing (henceforth, it is also called as overprinting) to the image supporting substrate which has been produced the foil image by transferring a foil on the first toner image in order to improve the power of expression.

As a method of overprinting, although there are methods of an electrophotographic method, an offset printing method, an ink-jet printing method, when the variation of and easiness of image supporting substrates to be used are taken into consideration, it is preferable to apply an electrophotographic method.

PRIOR ART DOCUMENTS

Patent Documents

Patent document 1: Japanese Patent Application Publication (hereafter it is called as JP-A) No. 5-279608

Patent document 2: JP-A No. 61-252190

Patent document 3: JP-A No. 2009-226863

SUMMARY

In some cases, there has been the following problem. When a toner image is produced (via overprinting) with an electrophotographic image forming method on an image supporting substrate on which a foil image has been formed on a foil transferring toner (it is a first toner used for forming a foil image), since the resin used for the foil transferring toner is a thermoplastic resin, this thermoplastic resin will be melted by the heating and pressure during the overprinting with a second toner to obtain a final image. And the thermoplastic resin constituting the foil transferring toner will be contracted or will be swelled. As a result, there may be produced a stripe type defect on the foil image melted on the foil transferring toner.

An object of the present invention is to provide a method for producing a print having a foil image and a toner image together and exhibiting a strong adhesiveness between the transferring foil layer and the foil transferring toner image without producing a stripe type defect on the foil image, even when a final toner image is produced (via overprinting) with an electrophotographic image forming method.

The above object of the present invention has been attained by the constitutions described below.

1. A method for producing a print having a toner image and a foil image, the method comprising the steps of:

forming a foil transferring toner image with a foil transferring toner on an image supporting substrate;

heating and pressing by laminating the foil transferring toner image onto a transferring foil layer of a transferring foil sheet which is composed of the transferring foil layer and a base film;

forming a foil image having the transferring foil layer on the foil transferring toner image by peeling off the base film after cooling the heated and pressed foil transferring toner image with the transferring foil layer; and forming a toner image with an image forming toner on the image supporting substrate having the foil transferring image, wherein the foil transferring toner contains a resin produced by a vinyl monomer represented by Formula (1) and a polyvalent metal compound.

Formula (1)

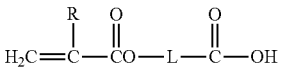

In Formula (1), R represents a hydrogen atom or a methyl group; and L represents a bivalent linking group which contains an ester bond in the structure.

2. The method for producing a print having a toner image and a foil image described in the above-described item 1, wherein a content of the vinyl monomer represented by Formula (1) in the resin which constitutes the foil transferring toner is 2 to 15 mass % based on the total mass of the foil transferring toner.

The method for producing a print having both a foil image and a toner image according to the present invention has superior effects of exhibiting a strong adhesiveness between the transferring foil layer and the foil transferring toner image without producing a stripe type defect on the foil image, even when a final toner image is produced (via overprinting) with an electrophotographic image forming method.

DESCRIPTION OF THE PREFERRED EMBODIMENT

Figure 1:
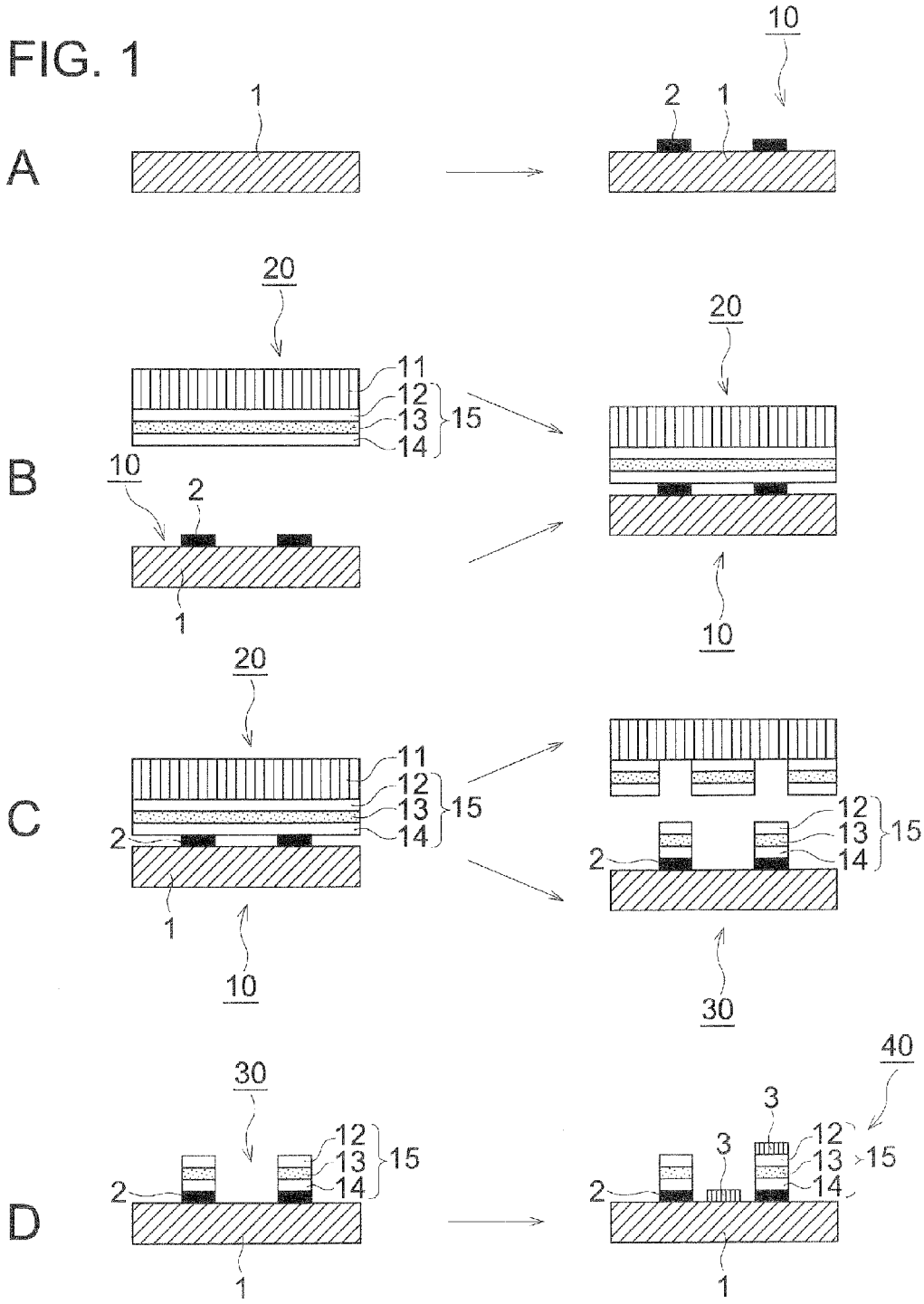
FIG. 1 is a schematic diagram which shows an example of the method for producing a print having a foil image and a toner image.

The present inventors have investigated to achieve the method for producing a print having both a foil image and a toner image, which exhibits a strong adhesiveness between the toner image and the foil image without producing a stripe type defect on the foil image portion, even when a final toner image is produced on the image supporting substrate which has been formed a foil image on the foil transferring toner image.

The present inventors have found the following after investigation. The foil image produced by transferring a transferring foil layer on a toner image with a foil transferring toner is excellent in adhesion property between the foil transferring toner image and the foil image and does not produce a stripe type defect on the portion of the foil image when the foil image is heated again during the formation of the final image.

In the present invention, it is assumed that the following processes proceed stepwise. The metal atoms are introduced between the chain portions of the resin molecules via thermal energy at the moment of thermal-fixing of the foil transferring toner on the image supporting substrate. Thereby a kind of cross-linking structure is formed via an ionic bond between the metals and the chains. Then, the polarized portions in the resin of the foil transferring toner are cross-linked gradually with the thermal energy during the production of a foil image. As a result, the viscosity of the resin in the foil transferring toner will be increased to result in preventing the heat melting and thermal shrinkage of the foil transferring toner when a final toner image was produced.

As a result, it is assumed that thermal stability of the resin in the foil transferring toner is increased, and heat melting, thermal shrinkage and thermal swelling of the resin are prevented by the heat when the final image is produced to result in obtaining a print having a foil image without a stripe type defect.

The method for producing a print having a toner image and a foil image contains the following steps:

1. forming a foil transferring toner image on an image supporting substrate with an electrophotographic image forming apparatus loaded with a foil transferring toner;

2. heating and pressing by laminating the foil transferring toner image onto a transferring foil layer of a transferring foil sheet which is composed of the transferring foil layer and a base film;

3. forming a foil image having the transferring foil layer on the foil transferring toner image by peeling off the base film after cooling the heated and pressed transferring toner image with the transferring foil layer; and 4. forming a print by producing a toner image on the image supporting substrate having the foil transferring image with the electrophotographic image forming apparatus loaded with an image forming toner.

Here, the foil transferring toner image and the toner image each may be formed using a same or a different electrophotographic image forming apparatus.

In order to past up the foil transferring toner and the transferring foil layer, it is required to fully melt the resin which constitutes the foil transferring toner.

Moreover, it is necessary to prevent the appearance of the stripe type defect on the foil image caused by the thermal shrinkage and thermal swelling of the foil transferring toner located under the foil image caused by the thermal fixing for producing the final image after forming the foil image.

In the present invention, the foil transferring toner contains the resin prepared by using a vinyl monomer having a carboxyl group represented by Formula (1). By using this foil transferring toner, the resin constituting the foil transferring toner is sufficiently melted to result in achieving an excellent adhesiveness of the foil transferring toner with the transferring foil layer of the transferring foil sheet. Further, thermal shrinkage and thermal swelling of the resin in the foil transferring toner are not appeared by the re-heating at the time of producing the final toner image. Thus, it is prevented from appearing a stripe type defect caused by a strain between the foil transferring toner and the transferred foil.

The present invention will be detailed in the following.

<Foil Transferring Toner>

The foil transferring toner of the present invention, which is used for forming a foil image contains a resin prepared by using a vinyl monomer represented by Formula (1).

Formula (1)

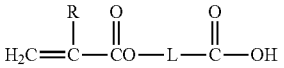

In Formula (1), R represents a hydrogen atom or a methyl group; and L represents a bivalent linking group which contains an ester bond in the structure. It is preferable that the foil transferring toner contains a resin prepared by a vinyl monomer represented by Formula (1) in an amount of 2 to 15 mass % based on the total resin which constitutes the foil transferring toner.

By using the vinyl monomer represented by Formula (1), the cross-linking reaction can be controlled step-by-step, and the adhesiveness of the transferred foil layer can be improved.

When the content of the vinyl monomer represented by Formula (1) in the resin which constitutes the foil transferring toner is too large, the cross-linking reaction will be excessive and the adhesiveness between the transferred foil layer and the foil transferring toner becomes decreased.

When the content of the vinyl monomer represented by Formula (1) is too small, sufficient cross-linking reaction will not occur, and the foil transferring toner will be deformed by shrinkage and swelling, which will result in difficulty to prevent the stripe type defect from occurring.

When an overprinted toner image is fixed on the image supporting substrate, since the ester bond will be protected by the presence of "L" linking to the carboxylic group in Formula (1), it will take place predominantly an ionomer reaction and an acid condensation reaction between a carboxylic group and a polyvalent metal ion.

However, the L portion has a structure having a certain length, the resin molecules bonded via cross-linking will be prevented from moving and the viscosity will be increased. By this effect, the appearance of the strain of the foil image and the stripe type defect can be restrained.

In the present invention, an ionomer reaction designates a kind of cross-linking reaction via the metal-ion bonding by introduction of the metal atoms between the chain portions of the resin molecules.

An ionomer reaction and an acid condensation reaction will take place by adding a polyvalent compound. An ionomer reaction will easily proceed by adding an inorganic polyvalent metal compound, while an acid condensation reaction will easily proceed by adding an organic polyvalent metal compound. Since the resin involved in the acid condensation has a tendency of degraded fixation characteristics compared with the resin involved in the ionomer reaction, it is preferable that the addition amount of an organic polyvalent metal compound is smaller than the addition amount of the inorganic polyvalent metal compound.

The following reaction scheme 1 shows an example of a kind of cross-linking structure formation via an ionic bond between the metals and the chains, in which the metal atoms are introduced between the chain portions of the resin molecules via thermal energy at the moment of thermal-fixing of the foil transferring toner on the image supporting substrate.

Reaction scheme 1

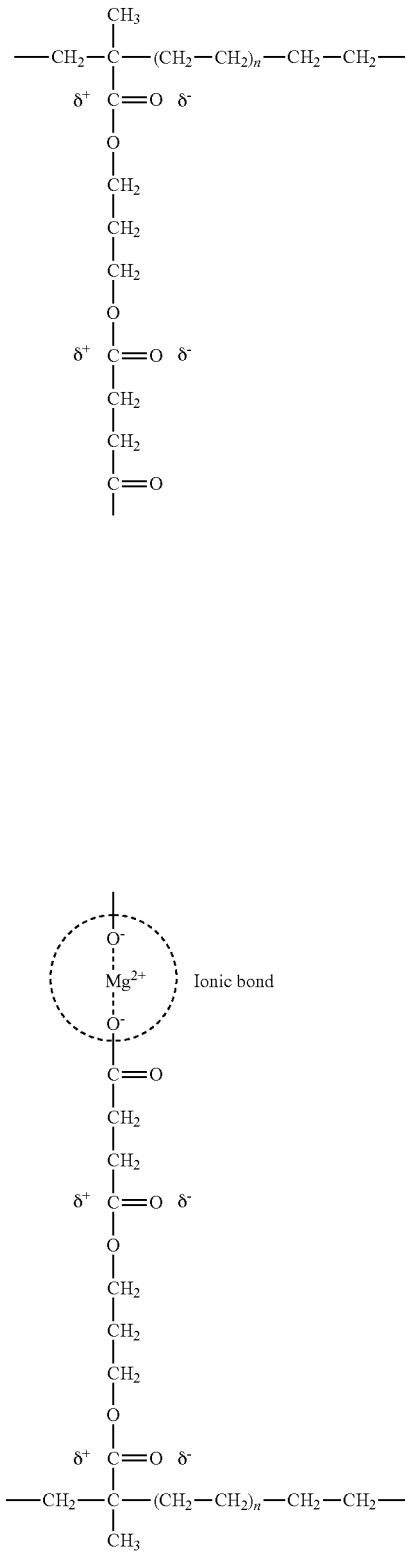

The following reaction scheme 2 shows an example of a state when the reaction progresses gradually, in which the polarized portions in the resin are cross-linked with the thermal energy during the production of a foil image.

Reaction scheme 2

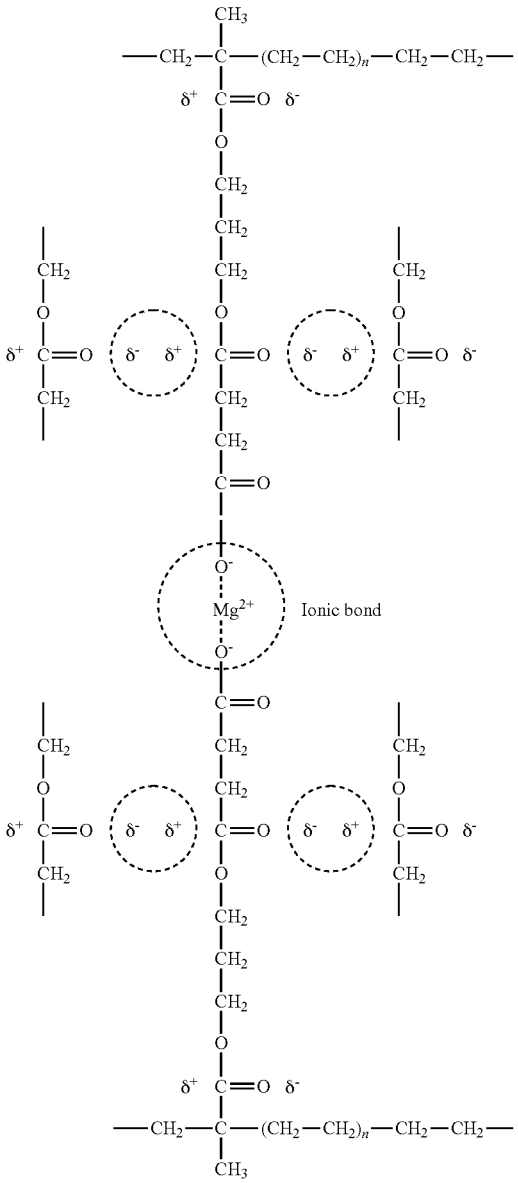

The foil transferring toner of the present invention may be a colored toner containing a colorant such as a black toner. Since a transferring foil is formed on the foil transferring toner, it is not required that the toner is colored. It is preferable to use a clear toner containing no colorant by considering the cost of the toner.

<Vinyl Monomer Represented by Formula (1)>

The bivalent linking group represented by L is preferably further represented by $L_1$ or $L_2$.

$L_1$

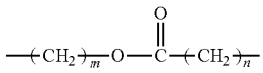

In $L_1$, m is an integer of 1 to 14; and n is an integer of 1 to 10.

$L_2$

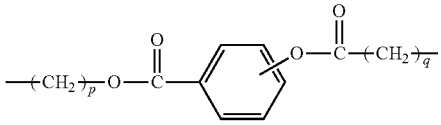

In $L_2$, p is an integer of 1 to 14; and q is an integer of 1 to 10.

A vinyl monomer represented by the above-mentioned Formula (1) can be produced with an esterification reaction between a derivative of the (meth)acrylate which has a hydroxyl group, and an aliphatic dicarboxylic acid such as succinic acid, malonic acid, or glutaric acid, or an aromatic dicarboxylic acid such as phthalic acid.

In addition, the above-mentioned dicarboxylic acid may be substituted with a halogen atom, a lower alkyl group, or the alkoxyl group, or it may be an acid anhydride.

As examples of a vinyl monomer represented by Formula (1), the "Compounds 1 to 6" shown below can be cited.

Compound 1

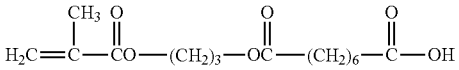

(R = $CH_3$, Carbon number of L = 10)

Compound 2

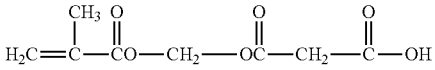

(R = $CH_3$, Carbon number of L = 3)

Compound 3

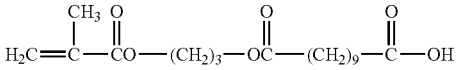

(R = $CH_3$, Carbon number of L = 13)

Compound 4

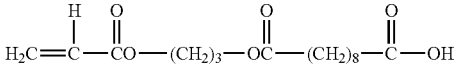

(R = $CH_3$, Carbon number of L = 12)

Compound 5

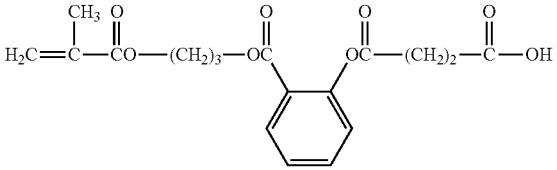

(R = $CH_3$, Carbon number of L = 13)

-continued

Compound 6

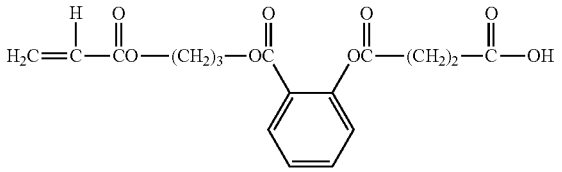

(R = $CH_3$, Carbon number of L = 13)

Compound 7

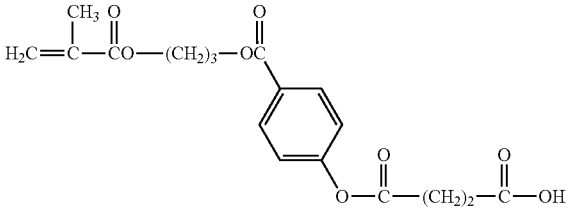

(R = $CH_3$, Carbon number of L = 13)

Compound 8

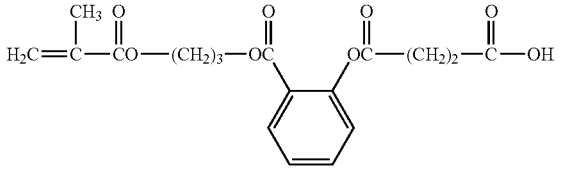

(R = $CH_3$, Carbon number of L = 13)

<Resin which Constitutes Foil Transferring Toner>

As a resin which constitutes the foil transferring toner, it is preferable to use a compound prepared by polymerization of a vinyl monomer represented by Formula (1) and other polymerizable monomer.

The resin which constitutes the foil transferring toner can be prepared by using a vinyl monomer having a carboxyl group in the molecule and by adding a polyvalent metal compound in the step of emulsion aggregation step. Thus, a carboxyl group and a polyvalent metal compound can be incorporated in the resin.

Examples of a polymerizable vinyl monomer which can be used in combination with the vinyl monomer represented by the foregoing Formula (1) are shown below.

(1) Styrene or styrene derivatives:

for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecyl styrene.

(2) Methacrylate derivatives;

for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate.

(3) Acrylate derivatives:

for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

(4) Olefins:

for example, ethylene, propylene and isobutylene.

(5) Vinyl esters:

for example, vinyl propionate, vinyl acetates and vinyl benzoate.

(6) Vinyl ethers:

for example, vinyl methyl ether and vinyl ethyl ether.

(7) Vinyl ketones:

for example, vinyl methyl ketone, vinyl ethyl ketone and vinyl hexyl ketone.

(8) N-vinyl compounds:

for example, N-vinyl carbazole, and N-vinyl indole and N-vinyl pyrrolidone.

(9) Others:

for example, vinyl compounds such as vinyl naphthalene and vinyl pyridine, acrylic acid derivatives or methacrylic acid derivatives such as acrylonitrile, methacrylonitrile and acrylamide.

It is possible to use a polyfunctional vinyl monomer so as to form a resin having a cross-linking structure. Specific examples of the polyfunctional vinyl compounds will be shown below.

Examples of the polyfunctional vinyl monomer are: divinylbenzene, ethylene glycol dimethacrylate, ethylene glycol diacrylate, diethyleneglycol dimethacrylate, diethyleneglycol diacrylate, triethylene glycol dimethacrylate, triethylene glycol diacrylate, neopentyl glycol dimethacrylate and neopentyl glycol diacrylate.

The molecular weight of the aforesaid resin is not specifically limited as long as it can produce a toner which exhibits a strung adhesiveness between the transferred foil layer and the produced toner. For example, it is preferable that the number average molecular weight Mn of the resin is in the range of 10,000 to 100,000.

<Releasing Agents>

The foil transferring toner used in the present invention may contain a releasing agent, and known releasing agents may be used. Specifically used releasing agents are, for example: low-molecular weight polyolefins such as polyethylene, polypropylene and polybutene; plant waxes such as synthesized ester wax, carnauba wax, rice wax, candelilla wax, tree wax and jojoba oil; mineral or oil waxes such as montan wax, paraffin wax, microcrystalline wax and Fischer-Tropsch wax; and modified compounds thereof.

Among the above cited releasing agents, the synthesized ester waxes having a melting point of 70 to 95° C. are particularly preferably used from the view of preventing the filming. Examples of the synthesized ester wax include: behenyl behenate, pentaerythritol tetrabehenate and tribehenyl citrate. Further, the synthesized ester wax (such as behenyl behenate, pentaerythritol tetrabehenate, and tribehenyl citrate) and the paraffin wax having the melting point of 75 to 100° C. may be used together, thereby the filming-resistant property can be improved.

Among the paraffin wax, it can be improved the offset property in the high-temperature region regardless of the processing speed ranging from the low-speed region to the high-speed region, when Fischer-Tropsch wax having the melting point of 75 to 100° C. is used. In addition, an electrophotographic image forming apparatus having a cleaning blade as a cleaning section can provide a favorable blade cleaning performance.

The amount of the releasing agent contained in the toner is preferably 2 to 20 mass %, and more preferably 5 to 13 mass %. An offset may be generated in the high-temperature region when the amount is less than 2 mass %, and the releasing agent is less likely to be incorporated inside of the toner when the amount is more than 20 mass %. As a result, the releasing agent may be separated from the toner particles and the portion of the releasing agent which has not been incorporated into the toner particles may be attached to the toner surface, and they may adverse effect to the adhesiveness of the transferring foil layer and the toner.

<Polyvalent Metal Compounds>

The polyvalent metal compounds used in the present invention include: inorganic metal compounds and organic metal compounds.

A content of the polyvalent metal compound with respect to 1 mole of vinyl monomer represented by Formula (1) is preferably 1.0 to 20 mole in case of inorganic polyvalent metal compounds, and 0.1 to 10 mole in case of organic polyvalent metal compounds When the content of polyvalent metal compound is too much, the cross-linkage structure will become excessive and the adhesion property of the transferring foil layer and the foil transferring toner image will be decreased.

On the other hand, the content of polyvalent metal compound is too small, a sufficient amount of cross-linkage structure will not be obtained, and it will become difficult to control the development of a stripe type defect at the time of re-heating.

As a polyvalent metal compound, the inorganic polyvalent metal compound or the organic polyvalent metal compound of 2 valent or 3 valent is preferable, and these can be used together.

By using the polyvalent metal compound of 2 valent or 3 valent, the preparation of the foil transferring toner can be easily performed, and at the same time, since an ionic bond progresses easily with the metal ion of the polyvalent metal compound contained in toner particles, it is desirable.

Examples of the inorganic polyvalent metal compound include: a fluoride, a chloride, a chlorate, a bromide, an iodide, an oxide, a hydroxide, a sulfide, a sulfite, a sulfate, a selenide, a telluride, a nitride, a nitrate, a phosphide, a phosphinate and a phosphate.

Examples of the organic polyvalent metal compound include: a carbonate, an orthosilicic acid salt, an acetate, an alkyl metal compound such as a methyl compound and an ethyl compound, an alkyl acid salt, an aromatic acid salt, a dicarboxylic acid salt and an alkoxy metal compound.

Examples of an alkyl metal compound include: dibutyl tin oxide, aluminium triethoxide and aluminium tributoxide.

Examples of an alkyl acid salt include: aluminium laurate, magnesium laurate, aluminium oleate, magnesium oleate, aluminium stearate, aluminium stearate and magnesium stearate.

The identification of the polyvalent metal element and the measurement of its amount can be done using X-ray fluorescence spectrometer (WDX) "XRF-1700" (made by Shimadzu Co. Ltd.) The measurement is performed by making a pellet by pressing a sample of 2 g of toner, followed by doing qualitative and quantitative analysis.

The foil transferring toner of the present invention cannot be prepared when a monovalent metal compound is used.

<The Method for Producing a Print Having a Toner Image and a Foil Image>

The method for producing a print having a toner image and a foil image contains the following steps:

1. forming a foil transferring toner image on an image supporting substrate with an electrophotographic image forming apparatus loaded with a foil transferring toner;

2. heating and pressing by laminating the foil transferring toner image onto a transferring foil layer of a transferring foil sheet which is composed of the transferring foil layer and a base film;

3. forming a foil image having the transferring foil layer on the foil transferring toner image by peeling off the base film after cooling the heated and pressed transferring toner image with the transferring foil layer; and 4. forming a print by producing a toner image on the image supporting substrate having the foil transferring image with the electrophotographic image forming apparatus loaded with an image foaming toner.

FIG. 1 is a schematic diagram which shows an example of the method for producing a print having a foil image and a toner image.

In FIG. 1, "A" shows the step of forming a foil transferring toner image on an image supporting substrate; "B" shows the step of heating and pressing the formed image by passing through a foil transferring apparatus; "C" shows the step of forming a foil image by peeling off the based film of the transferring foil sheet; and "ID" shows the step of forming a print having a toner image on the image supporting substrate. The numbers in the figures indicate as follows.

10: print provided with a foil transferring toner image on an image supporting substrate
1: image supporting substrate
2: foil transferring toner image
20: transferring foil sheet
11: base film
12: releasing layer
13: colorant layer
14: adhesion layer
15: transferring foil layer
30: print having a foil image formed on the foil transferring toner image by transferring a foil layer
40: print having a toner image and a toner image
3: toner image The print formed with a foil transferring toner image 10 is a material having a first toner image on the image supporting substrate 1.

The transferring foil sheet 20 is composed of a transferring foil layer 15 on a base film 11, and the transferring foil layer 15 is composed of a releasing layer 12, a colorant layer 13 and an adhesion layer 14 on a base film 11 in the sequence set forth from the base film 11.

The print having a foil image 30 is a material obtained by fusing the transferring foil layer 15 on the foil transferring toner image 2.

The print having a toner image and a toner image a material obtained by forming a toner image 3 on the image supporting substrate of the print having a foil image 30

The step A of FIG. 1 is a step of forming a foil transferring toner image 2 on an image supporting substrate 1 with a foil transferring toner loaded in an electrophotographic image forming apparatus.

The step B of FIG. 1 is a step of laminating the face of foil transferring toner image 2 on the image supporting substrate with the face of the transferring foil layer 15 of the transferring foil sheet followed by heating and pressing them using a pressure roller and a heating roller of a foil transferring apparatus. In this step, the foil transferring toner image 2 and the transferring foil layer 15 are adhered (fused) together.

The step C of FIG. 1 is a step of cooling the image supporting substrate 1 and the transferring foil sheet 20 after being adhered (fused) the foil transferring toner image 2 with the transferring foil layer 15, followed by peeling off the base film 11 from the image supporting substrate 1 to form a print 30 having a foil image formed on the foil transferring toner image.

The step D of FIG. 1 is a step of further forming a toner image 3 on the mage supporting substrate 1 provided with the transferring foil layer 15 using an electrophotographic image fanning apparatus resulting in forming a print 10 having a toner image and a toner image.

Each step will be described in the following.

<Print Provided with a Foil Transferring Toner Image>

The method of forming a print provided with a foil transferring toner image according to the present invention contains at least the following steps of:

(1) an electrostatic latent image forming step to form an electrostatic latent image on an electrophotographic photoreceptor;

(2) a development step to develop the electrostatic latent image on the electrophotographic photoreceptor using a developer containing a foil transferring toner;

(3) a transferring step to transfer the developed foil transferring toner image on an image supporting substrate; and (4) a fixing step to thermally fixing the transferred foil transferring toner image.

It may be possible to have additional steps in addition to the above-described four steps. For example, it is preferable to have a cleaning step to clean the image forming toner remained on the surface of the photoreceptor after transferring the toner image. Further, in the transferring step, it is possible to perform the transferring of the toner image through an intermediate transfer medium.

Figure 2:
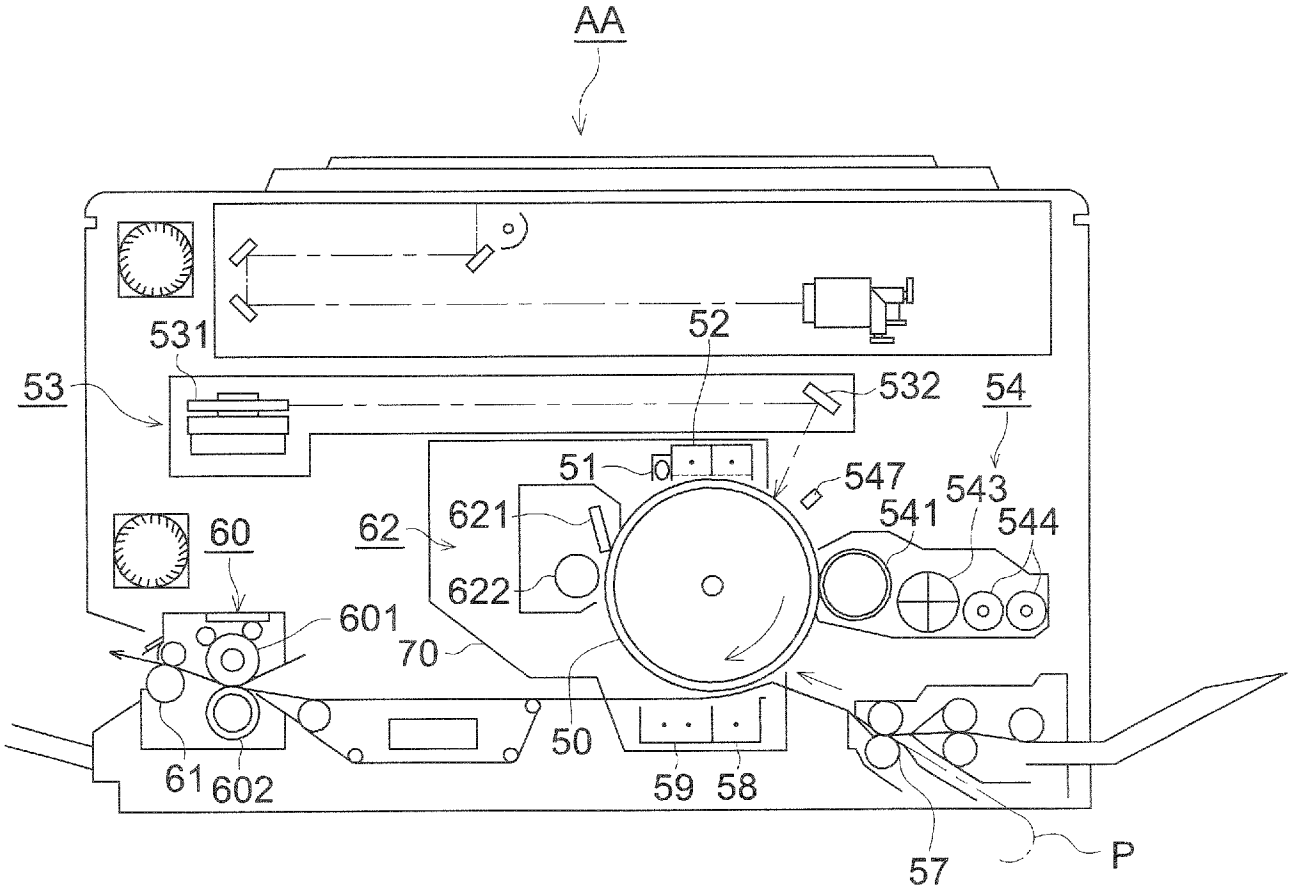
FIG. 2 is a schematic diagram which shows an example of an electrophotographic image forming apparatus used in the steps of: producing a pre-print having a foil transferring toner image on an image supporting substrate; producing a final toner image on the image supporting substrate which has been formed a foil image.

FIG. 2 is a schematic diagram which shows an example of an electrophotographic image forming apparatus used in the steps of producing a toner image on the image supporting substrate.

In FIG. 2, AA is an electrophotographic image forming apparatus, 50 is a photoreceptor which is driven clockwise with ground connection. 52 is a scorotron charger (charging device), and uniform charging is provided to the circumference of the photoreceptor 50 via corona discharge. Prior to the charging with this charger 52, it is possible to neutralize the circumference of the photoreceptor 50 by exposing with a pre-charge exposure device 51 using a light emitting diode in order to eliminate the past record of the photoreceptor in the previous image formation.

After performing uniform charging on the photoreceptor, imagewise exposure is given based on the image signals via an imagewise exposing device 53. The imagewise exposing device 53 in this figure uses an exposure light source which is not illustrated. The scanning on the photoreceptor is done with a light whose light path is bent by a rotating polygonal mirror 531 and a reflective mirror 532 through fθ lens, and an electrostatic latent image is produced.

The surface of the photoreceptor is uniformly charged with the charger 52, and the portion where imagewise exposure was performed, i.e., an electric potential of the photoreceptor at the exposed portion, (exposed region) is visualized in the developing step (by developing device). On the other hand, an unexposed portion electric potential is not developed with the developing bias potential impressed to a developing sleeve 541.

Next, the electrostatic latent image is developed by a developing device 54 used as a developing apparatus. At the periphery of the photoreceptor 50, there is placed the developing device 54 which incorporates a developer composed of a toner for toner images and a carrier, The development is carried out by the developing device 541 which rotated with incorporating a magnet and holding a developer. The developing device 54 contains a developer mixing and conveying components 544 and 543, and a conveying amount regulating component. Although the conveying amount of this developer changes depending on the linear velocity of the applied photoreceptor and specific gravity of the developer, generally, it is in the range of 20 to 200 mg/cm$^2$.

In addition, 70 in the figure is a process cartridge which can be detached and composed of integrated components of a photoreceptor, a charging device, a transfer device, a separator and a cleaning device. Since the toner for toner images concerning the present invention can perform high-speed developing by a small developing device which has a diameter of the above-mentioned range, it is especially suitable for the image forming apparatus having a process cartridge specification.

Moreover, the fixing methods that can be used for the image forming method employing the toner for toner images concerning the present invention is not specifically limited, and a well-known fixing method is applicable. As a well-known fixing method, there are cited: a roller fixing method composed of a heat roller and a pressure roller; a fixing method composed of a heat roller and a pressure belt; a fixing method composed of a heating belt and a pressure roller; and a belt fixing method composed of a heating belt and a pressure belt. Any one of these methods can be used. Further, as a heating method, it can be employed well-known heating methods, such as a method by using a halogen lamp and an IH fixing method.

<Preparation of a Print Having a Foil Image>

A print having a foil image can be prepared with the method containing the following steps: a step of laminating the face of foil transferring toner image on the image supporting substrate with the transferring foil layer using a pressure-heating rollers of a foil transferring apparatus; a step of peeling off the base film of the transferring foil sheet after cooling. In the latter step, the foil transfer toner and the adhesion layer in the transferring foil layer are bonded, and only the bonded portion of the transferring foil layer is peeled off from the base film to result in preparing a print having a foil image.

Figure 3:
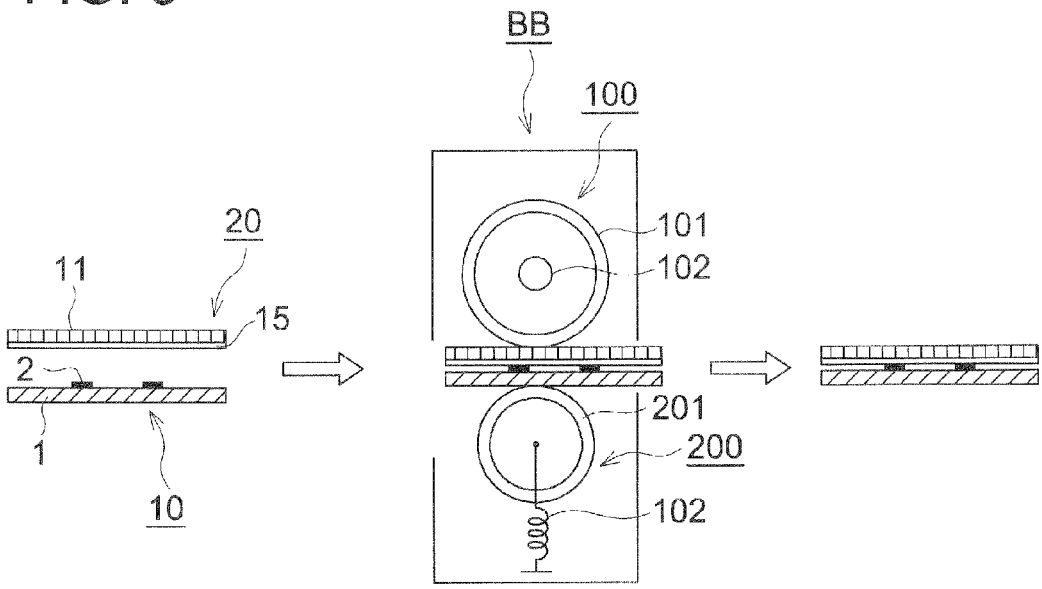
FIG. 3 is a schematic diagram which shows an example of a foil transferring apparatus used for producing a foil image on a foil transferring toner image.

FIG. 3 is a schematic diagram which shows an example of a foil transferring apparatus used in the step for producing a print having a foil image.

The numbers in FIG. 3 indicate as follows.

BB: foil transferring apparatus

1: image supporting substrate

2: foil transferring toner image

10: print having foil a transferring toner image

11: base film

15: transferring foil layer

20: transferring foil sheet

100: heat roller

101: silicone rubber layer provided on an aluminium substrate

102: heating source

200: pressure roller

201: silicone rubber layer provided on a aluminium substrate

202: pressure spring, and

Two hollow arrows between the images in the figure indicate the conveying direction of the print.

First, the face of the foil transferring toner image 2 of the print 10 having the foil transferring toner image and the transferring foil layer 15 are faced each other and they are introduced in the foil transferring apparatus having the following specifications. The image supporting substrate and the transferring foil sheet are ejected from the foil transferring apparatus in a condition of being heat-pressed with the heat roller and the pressure roller.

Specifications of Foil Transferring Apparatus (Specifications of Heat Roller and Pressure Roller)

Heat roller: an aluminium substrate having an outer diameter of 100 mm and a thickness of 10 mm provided with a 3 mm thick silicone rubber layer thereon Pressure roller: an aluminium substrate having an outer diameter of 80 mm and a thickness of 10 mm provided with a 3 mm thick silicone rubber layer thereon Heating source: halogen lamp installed interior of the heat roller (controlled with a thermistor)

Nip width between heat roller and pressure roller: 7 mm (Temperature Setting of Heat Roller)

Surface temperature of heat roller: setting up at 130° C.

(Conveying Speed)

23 to 80 mm/sec

In addition, as a foil transferring apparatus, although the apparatus shown in FIG. 3 can be used, it can be used a fixing device of an electrophotographic image forming apparatus by changing the conditions of temperature and pressure.

<Preparation of a Print Having a Foil Image and a Toner Image>

A print having a foil image and a toner image can be prepared by further forming a toner image on a print having previously formed a foil image thereon.

As an apparatus to form a toner image, it can be used an image forming apparatus used for the above-described foil transferring toner image.

Here, the toner image can be formed on an image supporting substrate and on a foil image.

The print having a transferred foil and a toner image is used for the purpose of an ornament image, and also for the purposes of preventing forgery and keeping security.

Next, the materials used in the present invention will be described.

<Image Supporting Substrate>

As materials for the image supporting substrate, it is not particularly limited as long as it is used for the method for forming an electrophotographic image. Usable examples thereof are: paper, plastic, metal, textile, and natural or synthetic leather.

<Transferring Foil>

As a kind of transferring foil, although there are cited a various kinds such as: metal foil, color pigment foil and hologram, the kinds are not limited in the present invention.

As a transferring foil used in the present invention, transferring foils of commercially available hot-melt type can be cited. Among them, the transferring foils used for transferring on soft vinyl or plastic are suitably used.

An example of a transferring foil is a material having a layer structure laminated with a releasing layer, a colorant layer and if required an adhesion layer on a base film in the order recited.

In FIG. 1, an example of a layer structure of a transferring foil sheet is illustrated.

In FIG. 1, 20 is a transferring foil sheet with its layer structure, 11 is a base film, 12 is a releasing layer, 13 is a colorant layer, 14 is an adhesion layer and 15 is a transferring foil layer.

[Base Film]

As a base film, it can be used a material composed of a film provided with a transferring foil layer. Examples of a film include resin sheets made of olefin resins such as polypropylene and polyethylene; polyester resin such as polyethylene terephthalate; vinyl chloride resin; and polyamide resin. The thickness of the base film is preferably 7 to 75 μm, and more preferably, it is 10 to 20 μm by considering the compatibility of strength and working efficiency.

[Transferring Foil Layer]

The transferring foil layer is composed of at least (1) a releasing layer; (2) a colorant layer (a colorant layer includes a reflective layer in the present invention); and (3) an adhesion layer.

(Releasing Layer)

A releasing layer is provided in order to make the transferring foil layer easily separate from the base film. As a releasing layer, a silicone resin, an olefin resin, wax, are used, for example.

(Colorant Layer)

A coloring layer is a layer which produces a colored image or a reflective figure, when produced on a foil transferring toner image.

In the present invention, a colorant layer is a general term designating the layers of a colorant layer containing a colorant and a reflective layer produced with vapor-deposited metal; and a composed layer of both a colorant layer and a reflective layer.

A colorant layer is composed of at least a colorant and a binder resin. A colorant is not limited in particular to an organic pigment, an inorganic pigment, or a dye. Although a binder resin is not limited in particular, it can be preferably used: an amino type cured resin such as a urea resin and a melamine resin, a cellulose resin and an acrylic resin from the viewpoint of heat-resistivity.

(Reflective Layer)

A reflecting layer is used in order to produce a foil image having a finish of metallic glossiness, and it is produced by preparing a reflecting layer by a well-known method using metal etc. As a metal material which produces a reflective layer, it can be used: a simple substance such as aluminium, tin, silver, chromium, nickel and gold. In addition, it can be used an alloy such as nickel-chromium-iron alloy, bronze and aluminum bronze. As a method to produce a reflective layer, there are cited well-known methods such as: a vacuum deposition method, a sputtering method and an ion plating method, for example. Moreover, it is also possible to perform a patterning treatment which gives a regular pattern to a reflective layer by using well-known processing methods, such as aqueous sealant processing, etching processing and laser processing.

(Adhesion Layer)

An adhesion layer is a layer having a property of bonding to the foil transferring toner image face when it is subjected to heat-pressing followed by cooling. It is a layer composed of resin as a constituting material.

As a resin which constitutes an adhesion layer, it is used a hot-melt adhesive which becomes soft by heating and solidifies by cooling in the state of closely contacted with the foil transferring toner image face to result in producing an adhesive strength. Examples of a hot-melt adhesive include any kinds of thermoplastic resin adhesive such as: an ethylene-vinyl acetate copolymer bonding agent, a polyvinyl vinyl acetate bonding agent, a vinyl chloride bonding agent, a polyamide bonding agent, a polyester bonding agent and an acryl resin bonding agent.

Next, there will be described a method to obtain a print having a foil image and a toner image using the toner according to the present invention.

The composition of a print having a foil image and a toner image is illustrated as 40 in FIG. 1.

In FIG. 1,1 is an image supporting substrate, 2 is a foil transferring toner image, 3 is a toner image (a final toner image) and 15 is a transferring foil layer.

Next, there will be described preparation method of a foil transferring toner used in the present invention.

<Preparation of Foil Transferring Toners>

The foil transferring toner used in the present invention can be prepared via the following steps, for example:

(1) Dissolution/dispersion step to dissolve or to disperse a releasing agent in a radical-polymerizable monomer.
(2) Polymerization step to polymerize a radical-polymerizable monomer so as to prepare a resin particle dispersion liquid containing a releasing agent.
(3) Coagulation/fusion step to add a salting-out agent (a polyvalent metal compound) to an aqueous resin particle dispersion liquid so as to coagulate and to fuse the particles to obtain mother particles.
(4) Polyvalent metal compound incorporating step to add a polyvalent metal compound or an aqueous solution thereof when required, so as to incorporate a polyvalent metal compound in the toner mother particles.
(5) Ripening step to control the shape of the toner mother particles by giving heat energy thereto.
(6) Washing step to eliminate a surfactant from the produced toner mother particles after cooling the toner mother particle dispersion liquid followed by subjecting the dispersion liquid to solid-liquid separation treatment.
(7) Drying step to dry the washed toner mother particles, and when required, it may be subjected to the following step.
(8) External additive treatment to add an external additive to the dried toner mother particles.

There will be described the respective steps in the preparation of the foil transferring toner according to the present invention.

(1) Dissolution/Dispersion Step:

In this step, a releasing agent compound is dissolved in a radical-polymerizable monomer to prepare a radical-polymerizable monomer solution containing a releasing agent.

(2) Polymerization Step:

In this polymerization step, a radical-polymerizable monomer solution containing a releasing agent is added to an aqueous medium containing a surfactant. And droplets are formed by providing mechanical energy to the mixture. Subsequently, a water-soluble radical polymerization initiator is added thereto to promote polymerization within the droplets. An oil-soluble polymerization initiator may be contained in the droplets.

In the polymerization step, providing mechanical energy is needed to perform enforced emulsification to form droplets. Means for providing mechanical energy include those for providing strong stirring or ultrasonic energy, for example, a homomixer, an ultrasonic homogenizer or a Manton-Gaulin homomixer.

Resin microparticles containing a binder resin and a releasing agent are obtained in the polymerization step. The resin microparticles may be colored microparticles or non-colored ones. Colored microparticles can be obtained by polymerization of a monomer composition containing a colorant. In the case when using non-colored microparticles, in the coagulation/fusion step which will be described later, a dispersion liquid of colorant particles is added to a dispersion liquid of resin microparticles to allow the resin microparticles and the colorant particles to be fused to obtain toner mother particles.

(3) Coagulation/Fusion Step:

In the coagulation and fusion step, the resin microparticles obtained in the above-described polymerization step are subjected to salting-out/fusion to produce toner mother particles. In this coagulation and fusion step, a particulate internal additive such as a releasing agent or a charge-controlling agent may be coagulated and fused together with resin microparticles.

The salting-out/fusion means that coagulation and fusion are concurrently promoted and when grown to an intended particle size, a coagulation-terminating agent is added thereto to stop growth of the particles and optionally heating is continued to control the particle shape.

The aqueous medium used in the coagulation/fusion step refers to a medium that is mainly composed of water (at 50% by weight or more). A component other than water is a water-soluble organic solvent Examples thereof include methanol, ethanol, isopropanol, butanol, acetone, methyl ethyl ketone and tetrahydrofuran.

The process of salting-out/fusion as a preferred method of coagulation/fusion is conducted, for example, in the following manner. To water containing resin microparticles and colorant particles is added an agent for salting out (hereinafter, also denoted as salting-out agent), e.g., alkali metal salts, alkaline earth metal salts or trivalent metal salts, at a concentration higher than the critical coagulation concentration. Subsequently, the mixture is heated at a temperature (° C.) higher than the glass transition temperature of the resin microparticles and also higher than the melting peak temperature to promote fusion concurrently with salting out.

As a salting out agent, there can be cited polyvalent metal compounds, alkali metal salts and alkaline earth metal salts according to the present invention.

Of alkali metal salts and alkaline earth metal salts, alkali metals include, for example, lithium, potassium and sodium; and alkaline earth metals include magnesium calcium, strontium, and barium, of which potassium, sodium, magnesium, calcium and barium are preferred.

(4) Polyvalent Metal Compound Incorporating Step:

This step is a step to incorporate a polyvalent metal compound in the toner mother particles by adding a polyvalent metal compound or an aqueous solution thereof after carrying out salting-out/fusion.

The amount of the polyvalent metal compound to be added is determined according to the amount of the polyvalent metal compound used as a salting-out agent, the kind of the polyvalent metal compound newly incorporated, or the washing condition in the washing step which will be followed later.

(5) Ripening Step:

In the ripening step, the surface of the toner mother particles is controlled to be smooth and uniform. Concretely, the coagulation/fusion step is conducted at a relatively low heating temperature to retard the progress of toner mother particles being fused to each other so as to promote uniformity, or is controlled at a low heating temperature for a long period so that the surface of the toner mother particles becomes in the form of smooth and uniform.

(6) Cooling, Solid-Liquid Separation and Washing Step:

This step refers to a stage to subject a dispersion of the foregoing toner mother particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

In the solid-liquid separation and washing step, a solid-liquid separation treatment of separating toner mother particles from a toner mother particle dispersion liquid is conducted, then cooled to the prescribed temperature in the foregoing step and a washing treatment for removing adhered material such as a surfactant or salting-out agent from a separated toner cake (wetted aggregate of toner mother particles aggregated in a cake form) is applied. In this step, a filtration treatment is conducted, for example, by a centrifugal separation, filtration under reduced pressure using a Nutsche funnel or filtration using a filter press, but is not specifically limited.

(7) Drying Step:

In this step, the washed toner cake is subjected to a drying treatment to obtain dried toner mother particles. Drying machines usable in this step include, for example, a spray dryer, a vacuum freeze-drying machine, or a vacuum dryer. Preferably used are: a standing plate type dryer, a movable plate type dryer, a fluidized bed dryer, a rotary dryer and a stiffing dryer. The moisture content of the dried toner mother particles is preferably not more than 5 weight %, and more preferably not more than 2 weight %. When colored particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(8) External Additive Treatment:

In this step, the dried toner mother particles are optionally mixed with external additives to prepare a toner.

By the addition of external additives, fluidity and electrostatic-charging property of the foil transferring toner are improved. The kind of such external additives is not specifically limited but examples thereof include inorganic particles, organic particles and lubricants, as below.

As inorganic particles commonly known ones are usable and preferred examples thereof include silica, alumina and strontium titanate particles. Such inorganic particles may optionally be subjected to a hydrophobilization treatment.

Specific examples of silica particles include R-805, R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania particles include T-805 and T-604 which are commercially available from Nippon Aerosil Co. Ltd.; MT-100S, MT-100B, MT-500BS, MT-600, MT-600SJA-1 which are commercially available from Teika Co.; TA-300SI, TA-500, TAF-130, TAF-510 and TAF-510T which as commercially available from Fuji Titan Co., Ltd.; IT-S, IT-OB and IT-OC which as commercially available from Idemitsu Kosan Co., Ltd.

Examples of alumina microparticles include RFY-C and C-604 which are commercially available from Nippon Aerosil Co., Ltd.; and TTO-55, commercially available from Ishihara Sangyo Co., Ltd.

Spherical organic microparticles having a number-average primary particle size of 10 to 2,000 nm are usable as organic microparticles. Specifically, there is usable styrene or methyl methacrylate homopolymer or their copolymers.

There are also usable lubricants, such as long chain fatty acid metal salts to achieve enhanced cleaning ability or transferability. Examples of a long chain fatty acid metal salt include zinc, copper, magnesium, and calcium stearates; zinc, manganese, iron, copper and magnesium oleates; zinc, copper, magnesium, and calcium palmitates; zinc and calcium linolates; zinc and calcium ricinolates.

Such an external additive or lubricant is incorporated preferably in an amount of 0.1 to 10.0% by weight of the total foil transferring toner. The external additive or lubricant can be incorporated by using commonly known mixing devices such as a turbuler mixer, a HENSCHEL MIXER, a Nauter mixer or a V-shape mixer.

<Developer>

When the foil transferring toner is used as a developer, it may be used as a one component developer which is composed of only the toner, or it may be used as a two component toner which is composed of a toner and a carrier. In both cases, it can be achieved to form a good image exhibiting the effects of the present invention.

The carrier employed for the two component toner is not particularly limited, and commonly known earners and resin coated carriers can be used.

<Toner for Forming a Toner Image>

As a toner for forming a toner image of the present invention, it can be used commonly known toner.

EXAMPLES

Embodiments of the present invention will now be specifically described with the reference to examples, however the present invention is not limited thereto.

<Preparation of Foil Transferring Toners>

The foil transferring toner was prepared as follows.

(Preparation of Vinyl Monomers Represented by Formula (1))

The aforesaid "compounds 1 to 6" were prepared as vinyl monomers represented by Formula (1).

(Preparation of Resin Particle Dispersion Liquid 1)

(First Step Polymerization)

In a reaction vessel fitted with a stirrer, a temperature sensor, a cooling pipe, and a nitrogen introducing unit, was placed a solution of 1.5 mass parts of sodium polyoxyethylene-2-dodecyl ether sulfate dissolved in 1,300 mass parts of ion-exchanged water. After hearing the solution to 80° C., the mixture containing the following monomers was added. By using a mechanical dispersing apparatus CREAMIX (M Tech Co., Ltd) having a circulating path for 30 minutes, it was prepared a dispersion liquid containing emulsion particles (oil droplets).

Monomer Mixture:

| | |
|---|---|
| Styrene | 125 mass parts |
| n-Butyl acrylate | 45 mass parts |
| Methacrylic acid | 8.5 mass parts |
| Compound 1 | 11.4 mass parts |
| n-Octyl mercaptan | 0.77 mass parts |
| Electol WEP-3 (releasing agent) | 77 mass parts |

Subsequently, to this dispersion liquid was added an initiator solution of 6.3 mass parts of potassium persulfate dissolved in 120 mass parts of ion-exchanged water. This mixture was heated at 80° C. for 1 hour while stirring to polymerize the monomers, whereby a resin particle dispersion liquid was prepared.

(Second Step Polymerization)

To the prepared resin particle dispersion liquid was added a solution of 10.7 mass parts of potassium persulfate dissolved in 203 mass parts of ion-exchanged water. Then, the mixture containing the following monomers were added dropwise at the temperature condition of 82° C. over 1.5 hours.

Monomer Mixture:

| | |
|---|---|
| Styrene | 390 mass parts |
| n-Butyl acrylate | 139 mass parts |
| Methacrylic acid | 26.6 mass parts |
| Compound 1 | 35.5 mass parts |
| n-Octyl mercaptan | 13.2 mass parts |

After dropwise addition, polymerization reaction was carried out while stirred and heated for 1 hour, then the mixture was cooled to 28° C., whereby "Resin particles dispersion liquid 1" was prepared.

(Preparation of Resin Particle Dispersion Liquids 2 to 10)

"Resin particle dispersion liquids 2 to 10" each were prepared in the same manner as preparation of resin particle dispersion liquid 1 except that the amount and kind of polymerizable monomers, compound 1, releasing agent, polymerization initiator and chain transfer agent were changes as described in Table 1.

Table 1 shows the amount and the kind of the polymerizable monomers, the compound represented by Formula (1), the releasing agent, the polymerization initiator and the chain transfer agent used in the preparation of Resin particle dispersion liquids 2 to 10.

Subsequently, an aqueous solution, prepared by dissolving 75 mass parts of magnesium chloride in 75 mass parts of ion-exchanged water, was added while stirred over 20 minutes. After the addition, the resulting mixture was allowed to stand for three minutes, followed by further heating. The temperature of the above system was increased to reach the particle diameter of 3 μm. With keeping the temperature of the mixture at this temperature, the stirring speed was decreased so that aggregation and fusion process was continued.

Subsequently, the average diameter of aggregated particles was determined via "COULTER MULIISIZER 3 (produced by Beckmann Coulter Co.), and when the volume based median diameter reached 5.8 μm, an aqueous solution prepared by dissolving 215 mass parts of sodium chloride in 860 mass parts of ion-exchanged water was added, and particle growth was terminated After terminating particle growth, as a ripening treatment, the liquid temperature was increased to the temperature at which fusion between resin particles was allowed to continue to achieve the average circularity of 0.935 (determined by "FPIA-2100 made by Sysmex, Co. Ltd.), whereby "Toner mother particle" was prepared. After ripening treatment, the liquid temperature was cooled to 30° C., and pH of the liquid was regulated to 2.0 by adding hydrochloric acid and the stirring was stopped.

TABLE 1

| Resin particle | First Step Polymerization | | | | | | | | | Second Step Polymerization | | | | | | |
|---|---|---|---|---|---|---|---|---|---|---|---|---|---|---|---|---|
| | St | BA | MAA | Compound represented by Formula (1) | | | | Releasing agent | | St | BA | MAA | Compound represented by Formula (1) | | | |
| dispersion liquid No. | mass % | mass % | mass % | ** | mass % | *1 | *2 | Kind | mass parts | mass % | mass % | mass % | ** | mass % | *1 | *2 |
| 1 | 66.0 | 23.5 | 4.5 | **1 | 6.0 | 6.3 | 0.77 | WEP-3 | 77 | 66.0 | 23.5 | 4.5 | **1 | 6.0 | 6.3 | 0.77 |
| 2 | 70.0 | 23.5 | 4.5 | **1 | 2.0 | 6.5 | 0.80 | WEP-3 | 77 | 70.0 | 23.5 | 4.5 | **1 | 2.0 | 6.5 | 0.80 |
| 3 | 58.0 | 23.5 | 4.5 | **1 | 15.0 | 5.9 | 0.73 | WEP-3 | 77 | 58.0 | 23.5 | 4.5 | **1 | 15.0 | 5.9 | 0.73 |
| 4 | 55.0 | 23.5 | 4.5 | **1 | 17.0 | 5.8 | 0.71 | WEP-3 | 77 | 55.0 | 23.5 | 4.5 | **1 | 17.0 | 5.8 | 0.71 |
| 5 | 71.0 | 23.5 | 4.5 | **1 | 1.0 | 6.5 | 0.80 | WEP-3 | 77 | 71.0 | 23.5 | 4.5 | **1 | 1.0 | 6.5 | 0.80 |
| 6 | 70.5 | 24.0 | 5.5 | — | — | 6.6 | 0.81 | FNP-0090 | 73 | 70.5 | 24.0 | 5.5 | — | — | 6.6 | 0.81 |
| 7 | 59.0 | 25.0 | 6.5 | **2 | 6.0 | 6.4 | 0.79 | HNP-0190 | 73 | 59.0 | 25.0 | 8.5 | **2 | 6.5 | 6.4 | 0.79 |
| 8 | 59.0 | 25.0 | 6.5 | **3 | 6.0 | 6.3 | 0.77 | HNP-0190 | 73 | 59.0 | 25.0 | 8.5 | **3 | 6.5 | 6.3 | 0.77 |
| 9 | 59.0 | 25.0 | 6.5 | **4 | 6.0 | 6.3 | 0.78 | FNP-0090 | 73 | 59.0 | 25.0 | 8.5 | **4 | 6.5 | 6.3 | 0.78 |
| 10 | 59.0 | 25.0 | 6.5 | **5 | 6.0 | 6.3 | 0.78 | FNP-0090 | 73 | 59.0 | 25.0 | 8.5 | **5 | 6.5 | 6.3 | 0.78 |

St: styrene,
BA: butyl acrylate,
MAA: methacrylate,
**Compound
*1: polymerization initiator (KSP, mass parts),
*2: chain transfer agent (NOM, mass parts)

<Preparation of Foil Transferring Toner 1>

Into a reaction vessel fitted with a stirrer, a temperature sensor, a cooling pipe, and a nitrogen introducing unit were placed the following:

| | |
|---|---|
| "Resin particle dispersion liquid 1" (solid conversion parts) | 462 mass parts |
| Sodium polyoxyethylene-2-dodecyl ether sulfate | 2.0 mass parts |
| Ion-exchanged water | 1,200 mass parts. |

After regulating the liquid temperature to 25° C. while stirring, the pH was regulated to 10 by adding a 25% aqueous potassium hydroxide solution thereto.

The above prepared "Toner mother particle" was solid-liquid separated by using basket type centrifuge "MARK III, type 60×40 (produced by Matsumoto Machine Mfg. Co., Ltd.)", whereby a wet cake of "Toner mother particle" was prepared. The wet cake was washed with ion-exchanged water of 45° C. by using the basket type centrifuge above until an electric conductivity of filtrate reached to 5 μS/cm. After the washing process, drying was carried out by "Flash Jet Dryer (produced by Seishin Enterprise Co., Ltd)" to the water content of 1.0 mass %, whereby "Toner mother particle 1" was prepared.

Then, to the above prepared "Toner mother particle 1" were added the following external additives: 1 mass % of hydrophobic silica (number average primary particle diameter 12 nm; hydrophobicity 68); and 1 mass % of hydrophobic titanic oxide (number average primary particle diameter: 20 nm;

hydrophobicity 63). Then the mixture was mixed by employing a Henschel mixer (produced by Mitsui Miike Mining Co., Ltd.). Then, after coarse particles were eliminated with a sieve having an opening of 45 μm, "Foil transferring toner 1" was prepared.

In addition, the presence of magnesium chloride contained in Foil transferring toner 1 was confirmed by the amount of magnesium using WDX.

<Preparation of Foil Transferring Toners 2 to 10>

"Foil Transferring Toners 2 to 10" each were prepared in the same manner as preparation of Foil transferring toner 1 except that Resin particle dispersion liquid 1 was changed to "Resin particle dispersion liquids 2 to 10", respectively.

<Preparation of Foil Transferring Toner 11>

"Foil Transferring Toner 11" was prepared in the same manner as preparation of Foil transferring toner 1 except that 75 mass parts of magnesium chloride was changed to the combination of 55 mass parts of magnesium chloride and 10 mass parts of aluminium chloride.

<Preparation of Foil Transferring Toner 12>

Into a reaction vessel fitted with a stirrer, a temperature sensor, a cooling pipe, and a nitrogen introducing unit were placed the following:

| | |
|---|---|
| "Resin particle dispersion liquid 1" (solid conversion parts) | 462 mass parts |
| Sodium polyoxyethylene-2-dodecyl ether sulfate | 2.0 parts by mass |
| Ion-exchanged water | 1,200 parts by mass. |

After regulating the liquid temperature to 25° C. while stirring, the pH was regulated to 10 by adding a 25% aqueous potassium hydroxide solution thereto.

Subsequently, an aqueous solution, prepared by dissolving 75 mass parts of magnesium chloride in 75 mass parts of ion-exchanged water, was added while stirred over 20 minutes. After the addition, the resulting mixture was allowed to stand for three minutes, followed by further heating. The temperature of the above system was increased to reach the particle diameter of 3 μm. With keeping the temperature of the mixture at this temperature, the stirring speed was decreased so that aggregation and fusion process was continued.

Subsequently, the average diameter of aggregated particles was determined via "COULTER MULTISIZER 3 (produced by Beckmann Coulter Co.), and when the volume based median diameter reached 5.8 μm, an aqueous solution prepared by dissolving 215 mass parts of sodium chloride in 860 mass parts of ion-exchanged water was added, and particle growth was terminated Then, 130 mass parts of magnesium laurate was added, and the mixture was stirred.

After terminating particle growth, as a ripening treatment, the liquid temperature was increased to the temperature at which fusion between resin particles was allowed to continue to achieve the average circularity of 0.935 (determined by "FPIA-2100 made by Sysmex, Co. Ltd.), whereby "Toner mother particle" was prepared. After ripening treatment, the liquid temperature was cooled to 30° C., and pH of liquid was regulated to 2.0 by adding hydrochloric acid and the Mining was stopped.

The above prepared "Toner mother particle" was solid-liquid separated by using basket type centrifuge "MARK III, type 60×40 (produced by Matsumoto Machine Mfg. Co., Ltd.)", whereby a wet cake of "Toner mother particle" was prepared. The wet cake was washed with ion-exchanged water of 45° C. by using the basket type centrifuge above until an electric conductivity of filtrate reached to 5 μS/cm. After the washing process, drying was carried out by "Flash Jet Dryer (produced by Seishin Enterprise Co., Ltd)" to the water content of 1.0 mass %, whereby "Toner mother particle 12" was prepared.

Then, to the above prepared "Toner mother particle 12" were added the following external additives: 1 mass % of hydrophobic silica (number average primary particle diameter: 12 nm; hydrophobicity: 68); and 1 mass % of hydrophobic titanic oxide (number average primary particle diameter: 20 nm; hydrophobicity 63). Then the mixture was mixed by employing a Henschel mixer (produced by Mitsui Miike Mining Co., Ltd.). Then, after coarse particles were eliminated with a sieve having an opening of 45 μm, "Foil transferring toner 12" was prepared.

<Preparation of Foil Transferring Toner 13>

It was tried to prepare toner mother particle by changing magnesium chloride used in the preparation of Foil transferring toner 1 to the same amount of sodium chloride. However, it was failed to obtain the expected toner mother particle.

<Preparation of Foil Transferring Toner 14>

It was tried to prepare toner mother particle without magnesium chloride used in the preparation of Foil transferring toner 1 . However, it was failed to obtain the expected toner mother particle.

Resin particle dispersion liquids and polyvalent metal compounds used in preparation of Foil transferring toners 1 to 12 are listed in Table 2.

TABLE 2

| Foil transferring toner No. | Resin particle dispersion liquid No. | Polyvalent metal compound: Inorganic polyvalent metal compound: Compound | mass parts | Compound | mass parts | Organic polyvalent metal compound: Compound | mass parts | Contained (Yes) or No contained (None) |
|---|---|---|---|---|---|---|---|---|
| 1 | 1 | Magnesium chloride | 75 | None | 0 | None | 0 | Yes |
| 2 | 2 | Magnesium chloride | 75 | None | 0 | None | 0 | Yes |
| 3 | 3 | Magnesium chloride | 75 | None | 0 | None | 0 | Yes |
| 4 | 4 | Magnesium chloride | 75 | None | 0 | None | 0 | Yes |
| 5 | 5 | Magnesium chloride | 75 | None | 0 | None | 0 | Yes |
| 6 | 6 | Magnesium chloride | 75 | None | 0 | None | 0 | Yes |
| 7 | 7 | Magnesium chloride | 75 | None | 0 | None | 0 | Yes |
| 8 | 8 | Magnesium chloride | 75 | None | 0 | None | 0 | Yes |
| 9 | 9 | Magnesium chloride | 75 | None | 0 | None | 0 | Yes |
| 10 | 10 | Magnesium chloride | 75 | None | 0 | None | 0 | Yes |

TABLE 2-continued

| Foil transferring toner No. | Resin particle dispersion liquid No. | Polyvalent metal compound: Inorganic polyvalent metal compound: Compound | mass parts | Compound | mass parts | Organic polyvalent metal compound: Compound | mass parts | Contained (Yes) or No contained (None) |
|---|---|---|---|---|---|---|---|---|
| 11 | 1 | Magnesium chloride | 55 | Aluminium chloride | 10 | None | 0 | Yes |
| 12 | 1 | Magnesium chloride | 75 | None | 0 | Magnesium laurate | 30 | Yes |
| 13 | 1 | Sodium chloride | 75 | None | 0 | None | 0 | None |
| 14 | 1 | None | 0 | None | 0 | None | 0 | None |

<Preparation of Developer>

To a high speed mixer provided with a mixing blade were placed 100 mass parts of ferrite core particles and 5 mass parts of copolymer particles made of cyclohexyl methacrylate (copolymerization ratio of 5 to 5). Then, the mixture was mixed at 120° C. for 30 minutes to form a resin coating layer on the surface of ferrite core particle by the effect of mechanical force. Thus, ferrite carrier particles having a meridian diameter ($D_{50}$) of 60 μm were obtained.

To each of "Foil forming toners 1 to 12" prepared above was added the aforesaid carrier particles so that the toner content became 4 mass % with a V-type mixer. Thus there were prepared "Foil forming image developers 1 to 12".

<Preparation of Foil Transfer Sheet>

As a foil transfer sheet, a gold foil sheet "BL No. 2 Gold 2.8" and a hologram foil sheet "KP015YPP" both produced by Murata Kinpaku Co., Ltd) were used.

<Preparation of a Print Having a Foil Image and a Toner Image>

[Preparation of a Print Having a Foil Transferring Toner Image]

(Preparation of Print Having a Foil transferring toner image 1)

An image forming apparatus "Bizhub Pro6500" (made by Konica Minolta Business Technologies, Inc.) was used for producing a print having a foil transferring toner image.

The aforesaid Foil transferring toner 1 and Foil forming image developer 1 were loaded in the above-mentioned image forming apparatus. The toner coating weight to an A4 size paper "O.K. Topcoat paper (basis weight of 157 g/m$^2$)" (made by Oji Paper Co., Ltd.) was adjusted to 4 g/m$^2$. Print having a foil transferring toner image 1 was produced by forming a lattice image having a 2 mm width and a solid image having 2×5 cm in the region of 15 cm length×15 cm width.

(Preparation of Print Having a Foil transferring toner image 2 to 12)

"Print having a foil transferring toner image 2 to 12" each were prepared in the same manner as preparation of Print having a foil transferring toner image 1, except that Foil transferring toner 1 and Foil forming image developer 1 were changed to Foil transferring toners 2 to 12 and Foil forming image developer 2 to 12, respectively.

[Preparation of Print Having a Foil Image]

(Preparation of Print Having a Foil Image 1)

Preparation of Print having a foil image 1 was done according to the method described below.

A toner face of Print having a foil transferring toner image 1 prepared above and a transferring foil layer of a transferring foil sheet "Gold foil sheet BL No. 2 Gold 2.8" were laminated. Then, by using the foil transferring apparatus shown in FIG. 3 setting up in the following conditions, laminated materials were passed through heat and pressure rollers. After cooling to the room temperature, the base film of the transferring foil sheet was peeled off from the image supporting substrate to transfer the transferring foil on the foil transfer toner image. Thus, it was obtained Print having a foil image 1 containing a lattice image of 2 mm width and a solid image of 2×5 cm.

(Setting Conditions of Foil Transferring Apparatus)

Surface temperature of Heat roller: 130° C.

Conveying speed of image supporting substrate: 73 mm/second

Conveying direction of image supporting substrate: A4 size image support was conveyed in a longitudinal direction, Ambient conditions for evaluation: normal temperature and normal humidity (20° C., 50% R.H.)

(Preparation of Print Having a Foil Image 2 to 12)

"Print having a foil image 2 to 12" each were prepared in the same manner as preparation of Print having a foil image 1, except that Foil transferring toner 1 and Foil forming image developer 1 were changed to Foil transferring toners 2 to 12 and Foil forming image developers 2 to 12, respectively.

(Preparation of Print Having a Foil Image 13)

"Print having a foil image 13" was produced in the same manner as preparation of the aforesaid Print having a foil image 1, except that the Gold foil sheet was replaced with a hologram sheet "KP015TPP".

[Preparation of Print Having a Foil Image and a Toner Image 1 to 13]

"Print having a foil image and a toner image 1 to 13 each" were produced on "OK Topcoat paper" and on the foil image with a commercially available image forming apparatus "Bizhub Pro6500" (made by Konica Minolta Business Technologies, Inc.).

<Evaluation>

[Evaluation of Transferred Foil Layer]

The adhesiveness of the transferring foil layer was evaluated by Tape peeling off method.

On the lattice image of 2 mm width produced by transferring the transferring foil layer on the foil transferring toner image was adhered with "Scotch mending tape" (made by SUMITOMO 3M, Limited). Then the mending tape was peeled off. The condition of each foil image after peeling off was observed visually and it was evaluated according to the following criteria. Here, evaluation ranks A and B are considered as acceptable ranks.

(The Steps of Tape Peeling of Method)

(1) to adhere lightly Scotch mending tape No. 810-3-12 (made by SUMITOMO 3M, Limited) on the sample (2) to rub the surface of the mending tape 3.5 times of go and return with a pressure of 1 kPa (3) to peel off the mending tape at an angle of 180° C. with a force of 200 g (4) to observe visually the foil image after peeling off the mending tape (Evaluation Criteria)

A: No peeled off portion is observed on the lattice foil image.

B: A slight amount of peeled off portion is observed on the lattice foil image, but it is acceptable for practical use.

C: A large amount of peeled off portion is observed on the lattice foil image, and it is not acceptable for practical use.

[Evaluation of Stripe Type Defect]

The above-produced sample having a solid foil image of 2×5 cm was observed by employing a loupe having a magnification of 10 times. The appearance of the stripe type defects (such as embossment of the foil image in a shape of stripe, or crack of the foil image in a shape of stripe) were visually observed and evaluated by classifying according to the following evaluation criteria. Here, evaluation ranks A and B are considered as acceptable ranks.

(Evaluation Criteria)

A: No stripe type defects are observed on the solid foil image.

B: There are slightly observed stripe type defects on the solid foil image, but it is acceptable for practical use C. There are observed a large amount of stripe type defects on the solid foil image, and it is not acceptable for practical use.

The evaluation results are shown in Table 3.

TABLE 3

| Print (Print having a foil image and a toner image) No. | Foil transferring toner No. | Transferring foil sheet | Adhesiveness of Transferring foil layer | Stripe type defect | Remarks |
|---|---|---|---|---|---|
| 1 | Foil transferring toner 1 | Gold foil sheet | A | A | Inventive Example 1 |
| 2 | Foil transferring toner 2 | Gold foil sheet | A | B | Inventive Example 2 |
| 3 | Foil transferring toner 3 | Gold foil sheet | B | A | Inventive Example 3 |
| 4 | Foil transferring toner 4 | Gold foil sheet | B | A | Inventive Example 4 |
| 5 | Foil transferring toner 5 | Gold foil sheet | B | B | Inventive Example 5 |
| 6 | Foil transferring toner 6 | Gold foil sheet | A | C | Comparative Example 1 |
| 7 | Foil transferring toner 7 | Gold foil sheet | B | A | Inventive Example 6 |
| 8 | Foil transferring toner 8 | Gold foil sheet | A | B | Inventive Example 7 |
| 9 | Foil transferring toner 9 | Gold foil sheet | A | A | Inventive Example 8 |
| 10 | Foil transferring toner 10 | Gold foil sheet | A | A | Inventive Example 9 |
| 11 | Foil transferring toner 11 | Gold foil sheet | A | A | Inventive Example 10 |
| 12 | Foil transferring toner 12 | Gold foil sheet | B | A | Inventive Example 11 |
| 13 | Foil transferring toner 1 | Hologram foil sheet | A | A | Inventive Example 12 |
| 14 | Foil transferring toner 13 | — | — | — | Foil transferring toner image was not obtained |
| 15 | Foil transferring toner 4 | — | — | — | Foil transferring toner image was not obtained |

As is shown in Table 3, the prints each produced with Foil transferring toners 1 to 5 and 7 to 12, which satisfy the composition requirement of the present invention, exhibited excellent adhesiveness to the transferring foil layer. And the produced prints had no stripe type defect on the foil image.

On the other hand, when the Foil transferring toner 6 which does not satisfy the composition requirement of the present invention was used, it was confirmed that the produced print did not satisfy an acceptable evaluation rank of Stripe type defect.

What is claimed is:

1. A method for producing a print having a toner image and a foil image, the method comprising the steps of:

forming a foil transferring toner image with a foil transferring toner on an image supporting substrate;

heating and pressing by laminating the foil transferring toner image onto a transferring foil layer of a transferring foil sheet which is composed of the transferring foil layer and a base film;

forming a foil image having the transferring foil layer on the foil transferring toner image by peeling off the base film after cooling the heated and pressed foil transferring toner image with the transferring foil layer; and forming a toner image with an image forming toner on the image supporting substrate having the foil transferring image, wherein the foil transferring toner contains a resin produced by a vinyl monomer represented by Formula (1) and a polyvalent metal compound capable of crosslinking the resin via thermal energy:

Formula (1)

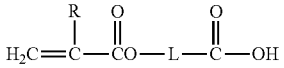

wherein, R represents a hydrogen atom or a methyl group; and L represents a bivalent linking group which contains an ester bond in the structure.

2. The method for producing a print haying a toner image and a foil image of claim 1, wherein a content of the vinyl monomer represented by Formula (1) in the resin which constitutes the foil transferring toner is 2 to 15 mass % based on the total mass of the foil transferring toner.

3. The method for producing a print having a toner image and a foil image of claim 1, wherein "L" in Formula (1) is represented by $L_1$ or $L_2$:

$L_1$

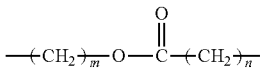

wherein, m is an integer of 1 to 14; and n is an integer of 1 to 10, $L_2$

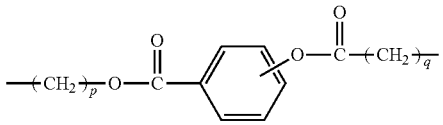

wherein, p is an integer of 1 to 14; and q is an integer of 1 to 10.

4. The method for producing a print having a toner image and a foil image of claim 1, wherein the polyvalent metal compound contained in the foil transferring toner contains a metal of 2 valent or 3 valent.

5. The method for producing a print having a toner image and a foil image of claim 4, wherein a content o f the polyvalent metal compound in the foil transferring toner is 0.1 to 10 mole with respect to 1.0 mole of the vinyl monomer.

6. The method for producing a print having a toner image and a foil image of claim 4, wherein the metal composing the oolyvalent metal compound is aluminium or magnesium.

7. The method for producing a print having a toner image and a foil image of claim 1, wherein the transferring foil sheet comprises:

a base film;

a releasing layer;

a colorant layer; and an adhesion layer.

8. The method for producing a print having a toner image and a foil image of claim 1, wherein the foil transferring toner image and the toner image each may be formed using a same or a different electrophotograohic image forming apparatus.

* * * * *